US005663743A

United States Patent [19]

Fujii et al.

[11] Patent Number: 5,663,743

[45] Date of Patent: Sep. 2, 1997

[54] DYNAMIC SCATTERING MATRIX LIQUID CRYSTAL DISPLAY HAVING VOLTAGE BOOSTER IN DRIVING VOLTAGE SUPPLY CIRCUIT

[75] Inventors: Tatsuhisa Fujii, Cyubu Mobara; Tomohide Ohira, Yokohama; Hiroshi Kunihara, Hayano Mobara, all of Japan

[73] Assignee: Hitachi, Ltd., Tokyo, Japan

[21] Appl. No.: 422,219

[22] Filed: Apr. 14, 1995

[30] Foreign Application Priority Data

Apr. 20, 1994 [JP] Japan ..... 6-081311

[51] Int. Cl.[6] ..... G09G 3/36

[52] U.S. Cl. ..... 345/95; 345/211

[58] Field of Search ..... 345/87, 92, 94, 345/95, 96, 99, 55, 50, 52, 53, 54, 211, 212; 359/54, 56, 59

[56] References Cited

U.S. PATENT DOCUMENTS

| | | | |
|---|---|---|---|
| 3,976,362 | 8/1976 | Kawakami . | |
| 4,922,243 | 5/1990 | Kozicki et al. | 345/212 |
| 5,200,741 | 4/1993 | Usui | 345/210 |
| 5,216,414 | 6/1993 | Fukutani et al. | 345/88 |
| 5,323,171 | 6/1994 | Yokouchi et al. | 345/211 |
| 5,402,142 | 3/1995 | Okada et al. | 345/100 |
| 5,465,102 | 11/1995 | Usui et al. | 345/89 |

*Primary Examiner*—Chanh Nguyen

*Attorney, Agent, or Firm*—Antonelli, Terry, Stout & Kraus, LLP

[57] ABSTRACT

A dynamic scattering matrix LCD, which requires a low expenditure of electric power without deteriorating contrast even when it is used for a high speed response STN liquid crystal display, includes a plurality of data line transparent electrodes, a plurality of scanning line transparent electrodes, data line drivers which selectively supply one of two levels of a first voltage signal to each of the data line transparent electrodes according to contents of a display image, scanning line drivers which selectively supply one of three levels of a second voltage signal to each of the scanning line transparent electrodes according to a control signal, and a voltage supply circuit which supplies the first voltage signal to the data line drivers and the second voltage signal to the scanning line drivers. The voltage supply circuit produces the two levels of the first voltage signal from two predetermined voltages without boosting the two predetermined voltages, and produces the highest and lowest levels of the three levels of the second voltage signal by boosting the two levels of the first voltage signal.

8 Claims, 6 Drawing Sheets

DYNAMIC SCATTERING MATRIX LIQUID CRYSTAL DISPLAY HAVING VOLTAGE BOOSTER IN DRIVING VOLTAGE SUPPLY CIRCUIT

BACKGROUND OF THE INVENTION

The present invention relates to a dynamic scattering matrix liquid crystal display and, more particularly, to a driving voltage supply circuit therefor to drive a high-speed response super twisted nematic (STN) liquid crystal with high contrast, and a matrix liquid crystal display using the driving voltage supply circuit.

The dynamic scattering matrix liquid crystal display has two spaced transparent substrates arranged opposite to each other, and there is a twisted structure liquid crystal layer disposed between those transparent substrates.

For example, one of the transparent substrates may have a plurality of data line transparent electrodes which are arranged thereon on the side of the liquid crystal layer, the data line transparent electrodes being arranged in the X direction. The other of the transparent substrates may have a plurality of scanning line transparent electrodes which are arranged thereon on the side of the liquid crystal layer, the scanning line transparent electrodes being arranged in the Y direction.

There are pixel regions at each of the crossing points between the data line transparent electrodes and the scanning line transparent electrodes, and each of the data line transparent electrodes is selectively supplied with one of two voltage levels from a data line driver circuit, while each of the scanning line transparent electrodes is selectively supplied with a select signal or a non-select signal from a scanning line driver circuit.

Further, the select signal and the non-select signal supplied to the scanning line transparent electrodes are controlled so as to convert their driving waveforms into alternating waveforms by inverting the polarity thereof. The inverting of polarity in order to avoid the generation of a defective orientation controlling layer phenomenon is well known.

In general, a liquid crystal display needs data line drivers and scanning line drivers for providing the driving waveforms as alternating waveforms, and a voltage supply circuit for these data line drivers and scanning line drivers.

The conventional voltage supply circuit, as shown in FIG. 5, has output terminals for supplying 6 levels of voltage. Thus, the conventional LCD (liquid crystal display) typically uses an amplitude-selective addressing scheme, and includes resistors and operational amplifiers. In accordance with the amplitude-selective addressing scheme, as shown in FIG. 6, voltages V2 and V4 for the data lines and voltages V1 and V5 for the scanning lines are supplied in a first cycle (e.g. a positive polarity cycle), and voltages V1 and V3 for the data lines and voltages V2 and V6 for the scanning lines are supplied in a second cycle (e.g. a negative polarity cycle).

The conventional voltage supply circuit of this type and the amplitude-selective addressing scheme are discussed in detail, for example, in U.S. Pat. No. 3,976,362 (Japanese Patent No. 1,210,988) to Kawakami.

Further, in the dynamic scattering matrix liquid crystal display, there can occur a missing mouse cursor phenomenon in which the operator may miss seeing the mouse cursor moving quickly, as a result of the difference between the driving principles of a TFT (thin film transistor) LCD representative of an active matrix LCD and the dynamic scattering matrix LCD.

Each of the transparent electrodes (ITO) disposed at the pixel regions of the active matrix LCD hold a static charge according to the voltage supplied from the data line driver for the period in which each scanning line (gate line) is not supplied with the predetermined select level voltage.

However, in the dynamic scattering matrix LCD, the display picture is determined by an effective voltage value in response to the potential difference for only a scanning period, thereby pulse driving the pixel regions at each crossing point between the data line transparent electrodes and the scanning line transparent electrodes.

SUMMARY OF THE INVENTION

In the conventional dynamic scattering matrix LCD, there is a large expenditure of electric power because a charging and discharging of electric current occurs between the highest voltage level and lowest voltage level when the voltage driver operates.

Accordingly, when the voltage level of V(LCD) shown in FIG. 5 is 25 V, the charging and discharging electric current is a maximum of 20 mA. So, the expenditure of electric power is a maximum of 500 mW in the conventional LCD.

Therefore, the first object of this invention is to provide a new dynamic scattering matrix LCD which is low in the expenditure of electric power without deteriorating the contrast, even when it is used for a high-speed response STN liquid crystal display.

To achieve the above first object, the dynamic scattering matrix liquid crystal display according to this invention includes:

a plurality of data line transparent electrodes and a plurality of scanning line transparent electrodes which are arranged opposite to each other so as to cross each other on opposite sides of a liquid crystal layer;

data line drivers for selectively supplying one of two levels of a first voltage signal according to the contents of a display image to each of said data line transparent electrodes;

scanning line drivers for selectively supplying one of three levels of a second voltage signal, according to a control signal for inverting the polarity of the voltage applied to the liquid crystal, to each of said scanning line transparent electrodes at a predetermined interval; and a voltage supply circuit for supplying said first voltage signal to said data line drivers and said second voltage signal to said scanning line drivers;

wherein said voltage supply circuit has a voltage booster for boosting a predetermined voltage to said two levels of said first voltage signal and said three levels of said second voltage signal to form logic voltages supplied to said data line drivers and said scanning line drivers, respectively, and said voltage supply circuit assigns an intermediate level of said logic voltages as a non-select level signal for said scanning line transparent electrodes and assigns the highest and lowest levels of said logic voltages as a select level signal for said scanning line transparent electrodes.

Further, the voltage booster has a pair of boosting circuits for boosting the predetermined voltage to said two levels of said first voltage signal and said highest and lowest levels of said second voltage signal by boosting said predetermined voltage to logic voltages on the positive polarity side and logic voltages on the negative polarity side with the same boost ratio on the basis of said non-select level signal.

Further, the voltage booster has control means for adjusting a jitter of the boost ratio for said pair of boosting circuits.

Further, the frame frequency of a signal for driving said data line drivers and scanning line drivers is approximately 150 Hz to 360 Hz.

Further, the liquid crystal element of said liquid crystal layer contains a mixture containing 10–50 wt % of a phenylcyclohexane group liquid crystal having a structural element according to the following formula:

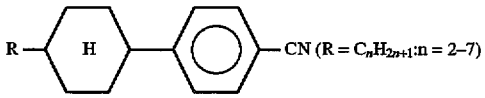

In the above mentioned structure, the data line drivers using the present invention supply only two level signals to the data line transparent electrodes in both the positive and negative polarity cycles. Accordingly, although the two level signals are inverted relative to each other as a result of inverting the polarity thereof, a potential difference exists therebetween of about 4 V.

This indicates that almost all of the charging and discharging electric current (18 mA) is supplied between the potential difference when the charging and discharging electric current is 20 mA. And, the voltage booster of the voltage supply circuit boosts said two level voltage signal of logic voltages to a three level voltage signal by boosting the logic voltages supplied to said data line drivers by 5 times, and said voltage supply circuit assigns the intermediate level of said three level voltage signal as a non-select level signal for said scanning line transparent electrodes and assigns the highest and lowest levels of said three level voltage signal as a select level signal for said scanning line transparent electrodes. The electric current supplied from these highest and lowest levels is about 2 mA.

Accordingly, the expenditure of electric power in the LCD using the present invention becomes as follows:

$$V\times(18\ mA+(2\ mA\times5))=140\ mW$$

So, the present invention can reduce the expenditure of electric power to ⅓ lower than that of a conventional LCD.

Further, the second object of this invention is to provide a new dynamic scattering matrix LCD which is a high-speed response STN LCD having the capability of displaying moving image data like a mouse cursor moving quickly in a display window.

To achieve the above second object, the dynamic scattering matrix liquid crystal display using this invention includes:

a plurality of data line transparent electrodes and a plurality of scanning line transparent electrodes which are arranged opposite to each other so as to cross each other on opposite sides of a liquid crystal layer;

data line drivers for selectively supplying one of two levels of a first voltage signal according to the contents of a display image to each of said data line transparent electrodes;

scanning line drivers for selectively supplying one of three levels of a second voltage signal, according to a control signal for inverting the polarity of the voltage applied to the liquid crystal, to each of said scanning line transparent electrodes at a predetermined interval; and a voltage supply circuit for supplying said first voltage signal to said data line drivers and said second voltage signal to said scanning line drivers;

wherein said voltage supply circuit has a voltage booster for boosting a predetermined voltage to said two levels of said first voltage signal and said three levels of said second voltage signal to form logic voltages supplied to said data line driver and said scanning line driver, respectively, and said voltage supply circuit assigns an intermediate level of said logic voltages as a non-select level signal for said scanning line transparent electrodes and assigns the highest and lowest levels of said logic voltages as a select level signal for said scanning line transparent electrodes, and the frame frequency of a signal for driving said data line drivers and scanning line drivers is approximately 150 Hz to 360 Hz.

When the LCD is driven at the above mentioned high frequency, it results in a large expenditure of electric power because the above mentioned charge and discharge electric current of the liquid crystal increases in proportion to the frame frequency thereof. For example, if the electric current is 20 mA when the frame frequency is 120 Hz, the electric current is 60 mA, which is three times 20 mA, when the frame frequency is 360 Hz. Accordingly, a simple calculation indicates that the expenditure of electric power becomes three times higher in a conventional LCD. However, an LCD using the present invention limits the electric power to substantially the same level as that of the conventional LCD when the frame frequency becomes three times that of the conventional LCD.

The size of the LCD using the present invention may be 9.4–10.4 inches, which is the diagonal of an LCD like a VGA (Video Graphics Array) or an SVGA (Super Video Graphics Array), 13.0–13.8 inches, which is a diagonal of an LCD like an SVGA having a low cost and a large size, and especially 16.6–17.6 inches, which is the diagonal of an LCD like an XGA (Extended Graphics Array) suitable for CAD.

In these embodiments, the term VGA means an LCD of which the number of the scanning lines is 480 and the number of the data lines is 640, the term SVGA means an LCD of which the number of the scanning lines is 600 and the number of the data lines is 800, and the term XGA means an LCD of which the number of the scanning lines is 768 and the number of the data lines is 1024.

The foregoing and other objects, advantages, manner of operation and novel features of the present invention will be understood from the following detailed description when read in connection with the accompanying drawings.

DESCRIPTION OF THE PREFERRED EMBODIMENT

Figure 1:
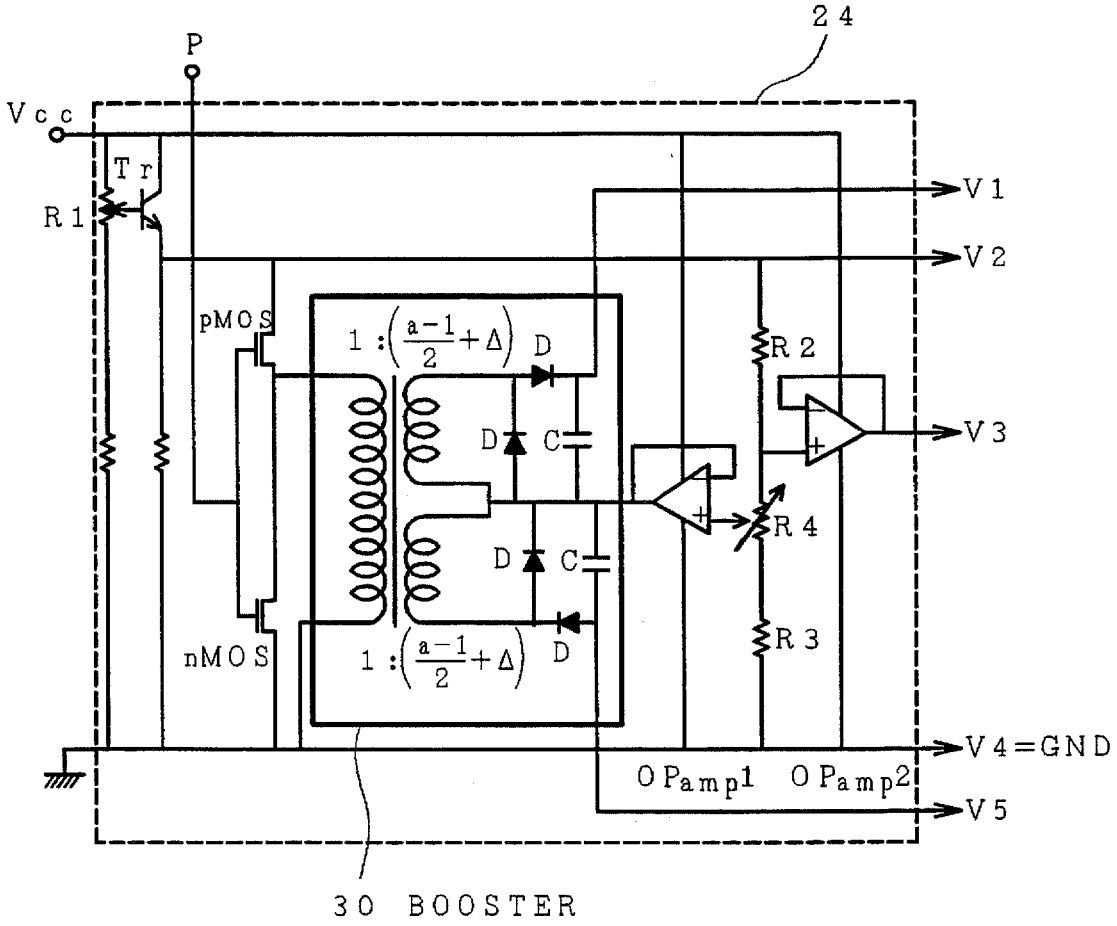
FIG. 1 is a schematic circuit diagram showing one embodiment of a power supply unit adapted for a dynamic scattering matrix LCD using this invention.
Figure 2:
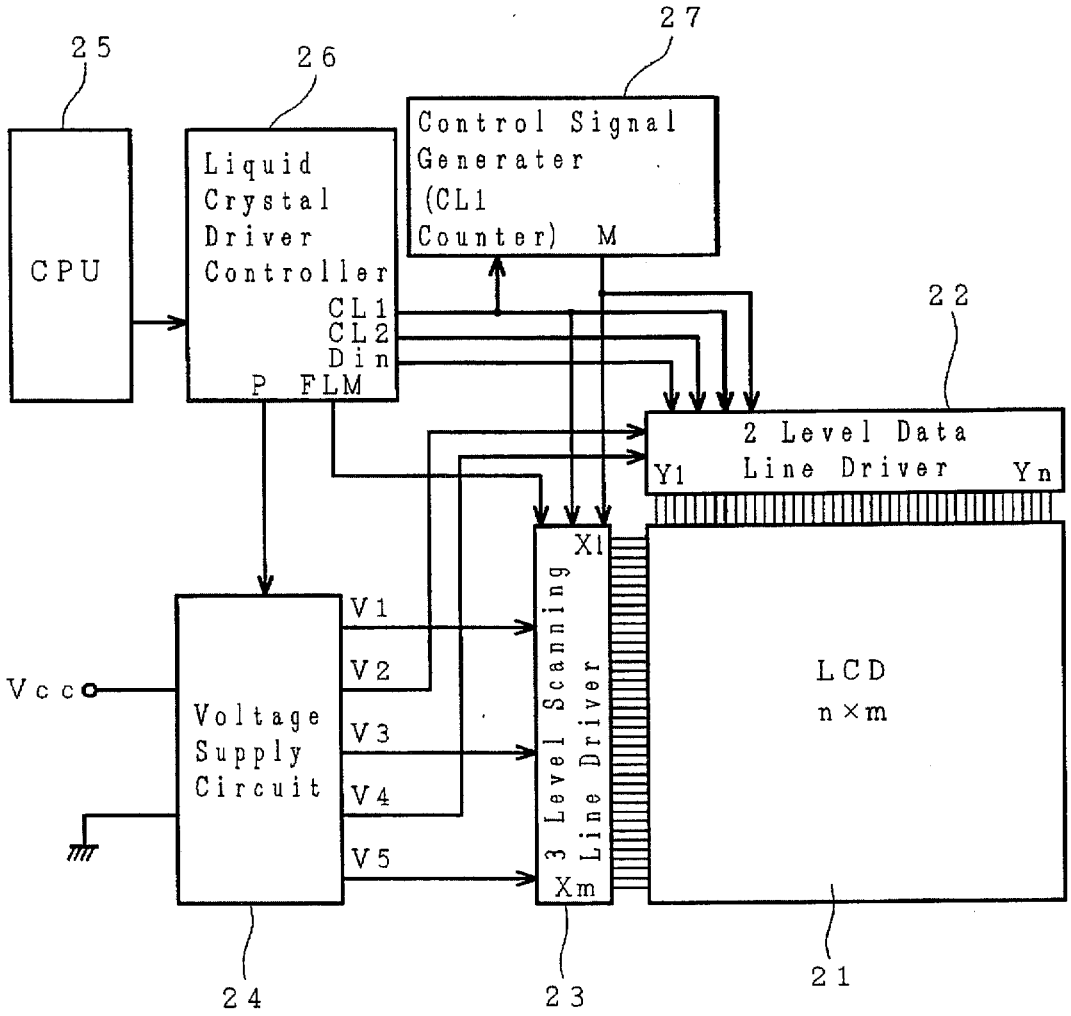
FIG. 2 is a block diagram showing the liquid crystal display unit of a dynamic scattering matrix LCD using this invention.

FIG. 1 is a schematic circuit diagram showing one embodiment of a power supply unit adapted for a dynamic scattering matrix LCD using this invention. FIG. 2 is a diagram showing the liquid crystal display unit of a dynamic scattering matrix LCD using this invention.

In FIG. 2, there is a liquid crystal display substrate 21 having two spaced transparent substrates (glass) arranged opposite to each other in a spaced relationship.

Additionally, one of the transparent substrates has n data lines which are arranged on one side of the liquid crystal layer, where the data lines extend in the X direction (the vertical direction in the drawing). Each of these data lines is connected to receive a data signal from a data line driver (data driving circuit) 22. The data signal consists of a 2 level signal.

The other of the transparent substrates has m scanning lines which are arranged on the other side of the liquid crystal layer, where the scanning lines extend in the Y direction (the horizontal direction in the drawing). Each of the scanning lines is connected to receive a scanning signal from a scanning line driver (scanning driving circuit) 23. The scanning signal consists of a 3 level signal.

There are pixel regions of the liquid crystal substrate 21 at each of the crossing points between the data lines and the scanning lines. The LCD has n×m pixels.

Each of the data line driver 22 and the scanning line driver 23 is supplied with driving voltages for forming a data signal and a scanning signal from a voltage (power) supply circuit 24. The voltage supply circuit 24 generates voltages V1, V2, V3, V4, and V5, which are of different level from each other, from a logic input voltage Vcc. The voltages V2 and V4 are supplied to the data line driver 22, and the voltages V1, V3, and V5 are supplied to the scanning line driver 23. The structure of the power supply circuit 24 will be explained in detail later.

Figure 3:
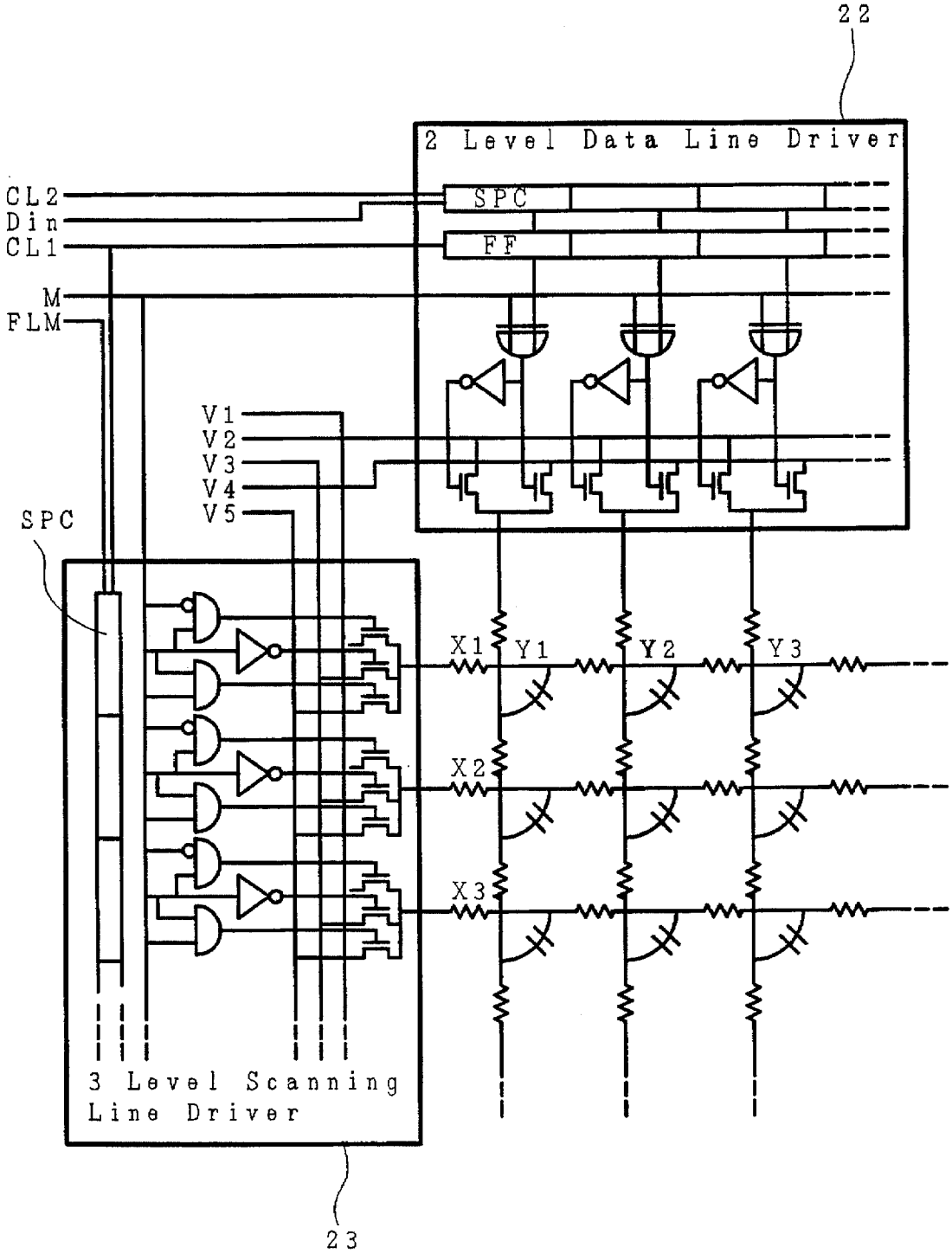
FIG. 3 is a schematic circuit diagram showing a data line driver and a scanning line driver adapted to a dynamic scattering matrix LCD using this invention.

On the other hand, a video signal from a CPU (computer) 25 is supplied to the data line driver 22 via a liquid crystal driver controller 26, and the data line driver 22 produces a data signal which has 2 levels corresponding to the driver voltages V2 and V4 on the basis of the video signal. Namely, the driver voltages V2 and V4 are supplied to the data lines via respective ones of a pair of MOS transistors, with one of the pair of MOS transistors being selectively turned on. FIG. 3 shows the structure of the data line driver 22.

Additionally, an FLM (first line marker) signal (a frame synchronizing signal) and a CL1 signal are supplied to the scanning line driver 23 from the driver controller 26, and the scanning line driver 23 supplies a scanning signal, which consists of three levels of V1, V3, and V5, to the scanning lines using the CL1 signal as a shifting signal and the FLM signal as a starting signal.

The driver voltages V1, V3, and V5 are supplied to the scanning lines via respective ones of a trio of MOS transistors, with one of the trio of MOS transistors being selectively turned on. FIG. 3 shows the structure of the scanning line driver 23. Further, the data signal from the data line driver 22 and the scanning signal from the scanning line driver 23 are controlled so as to convert the driving waveforms into alternating waveforms by inverting the polarity thereof on the basis of an M signal outputted from a control signal generator (inverting polarity signal generator) 27.

In the data line driver 22 and the scanning line driver 23, the above mentioned M signal is inputted into a logic circuit, and the logic circuit inverts the polarity of the logical information as a voltage signal on the basis of the M signal, as shown in FIG. 3.

FIG. 1 is a circuit diagram showing details of the structure of the voltage supply circuit 24.

The voltage V2 is generated from the voltage Vcc through the transistor Tr, and the voltage V4 is generated from the ground voltage of the transistor Tr. The transistor Tr has a function of controlling contrast, and a variable resistor R1 controls the electric current applied to the base of the transistor Tr. The emitter output of the transistor Tr is supplied to a dual auxiliary switch (complementary switch). The dual auxiliary switch consists of a p-MOS (metal oxide silicon) device and an n-MOS device, with the gates of these MOS devices being supplied with a pulse signal P.

A primary winding of a voltage booster 30 is supplied with a voltage pulse by mutual switching, according to the pulse signal P supplied to each MOS device of the complementary switch.

The voltage booster 30 includes a pair of output circuits having a common intermediate tap of a secondary winding, wherein the voltage level in the voltage booster 30 is boosted to a predetermined voltage at a ratio of $1:(((a-1)/2)+\Delta)$, and the voltages V1 and V5 are outputted from the voltage booster 30 via a rectifier balance circuit including diodes D and capacitors C.

The value $a=\sqrt{N}+1$, where N is a number of time divisions. This value of a provides an optimum bias in the amplitude-selective addressing scheme. The value $\Delta$ corrects the voltage boost ratio to generate a correct voltage by taking into account the voltage drop of the diode D.

The voltage V3 has the electric potential of the intermediate tap of the secondary winding of the voltage booster 30, and is supplied via the operational amplifier OPamp1 and the operational amplifier OPamp2.

The voltage supply circuit 24 includes resistors R2, R4, and R3, and the resistor R4 is a variable resistor which is adjusted such that R2=R4+R3.

By the above mentioned structure, the voltage supply circuit 24 is able to set the voltage V3 to be equal to the middle voltage between V2 and V4.

Thus, the LCD using the present invention reduces a lack of pixel uniformity caused by inverting the polarity of the scanning signal.

Figure 4:
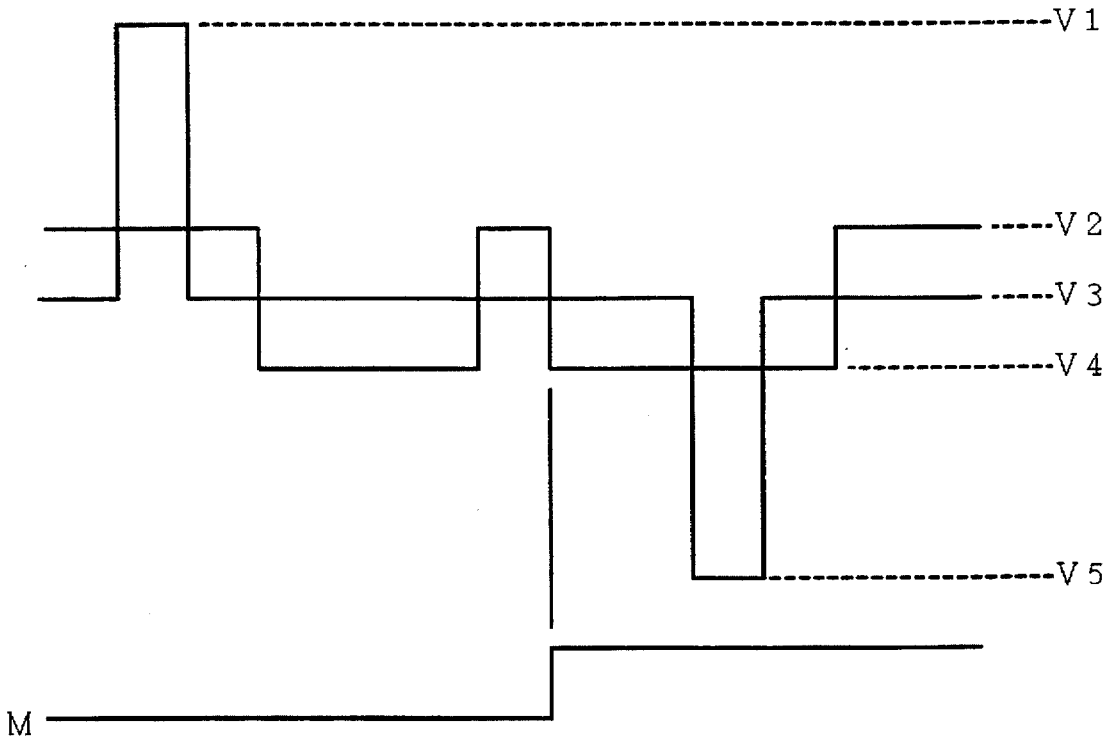
FIG. 4 is a diagram showing a time chart indicating a data signal and a scanning signal applied to a liquid crystal within a dynamic scattering matrix LCD using this invention.

FIG. 4 is a diagram showing a time chart indicating a data signal and a scanning signal inputted to the liquid crystal within a dynamic scattering matrix LCD 21 from the data line driver 22 and the scanning line driver 23, as shown in FIG. 2, on the basis of each of the voltage levels generated by the voltage supply circuit 24 having the above mentioned structure.

It will be seen clearly from FIG. 4 that the electric potential difference between a data signal and an inverted data signal is 4 V, which is the same as the electric potential difference of the logic power supply circuit.

Figure 5:
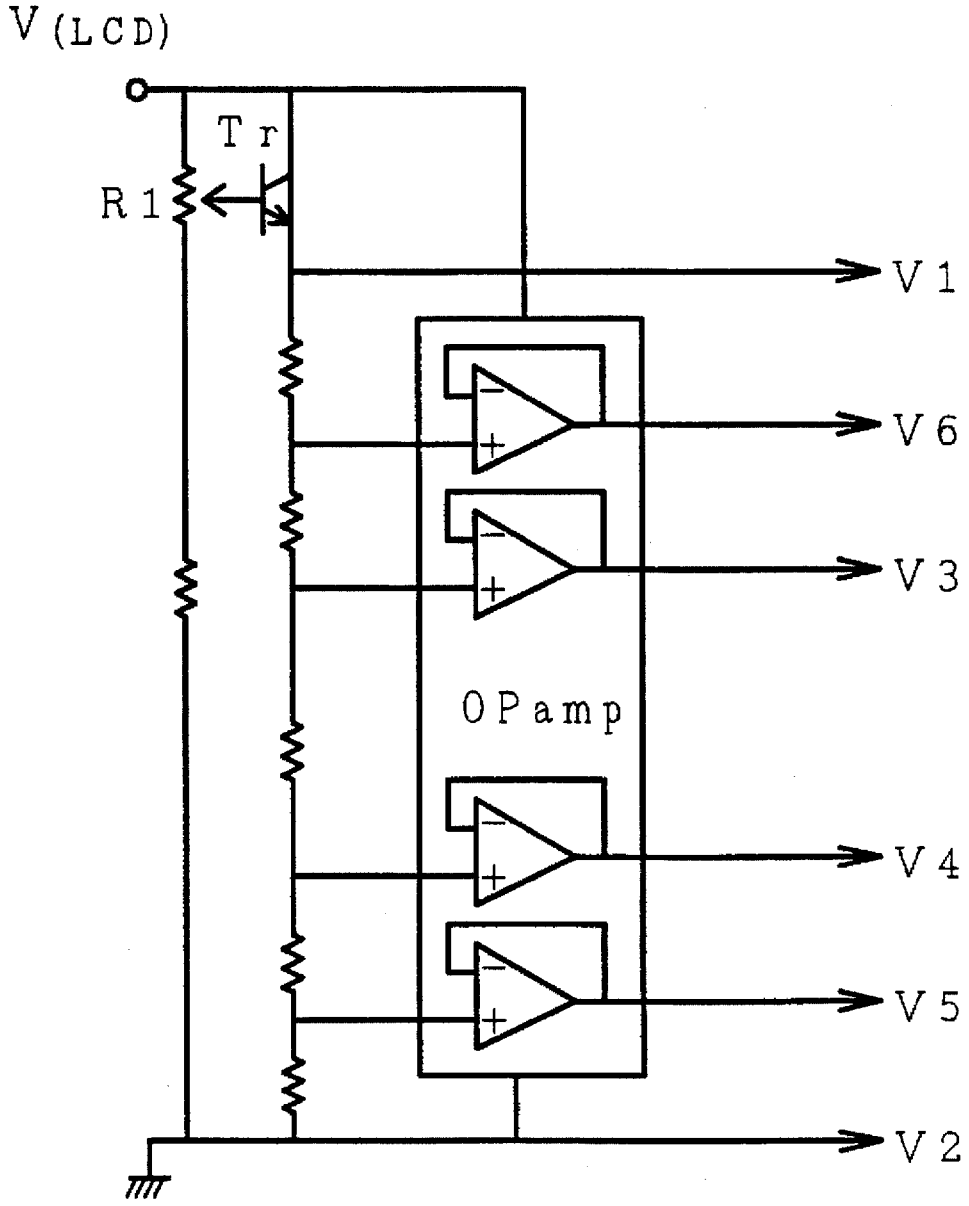
FIG. 5 (PRIOR ART)
FIG. 5 is a schematic circuit diagram showing a power supply circuit of a conventional LCD.
Figure 6:
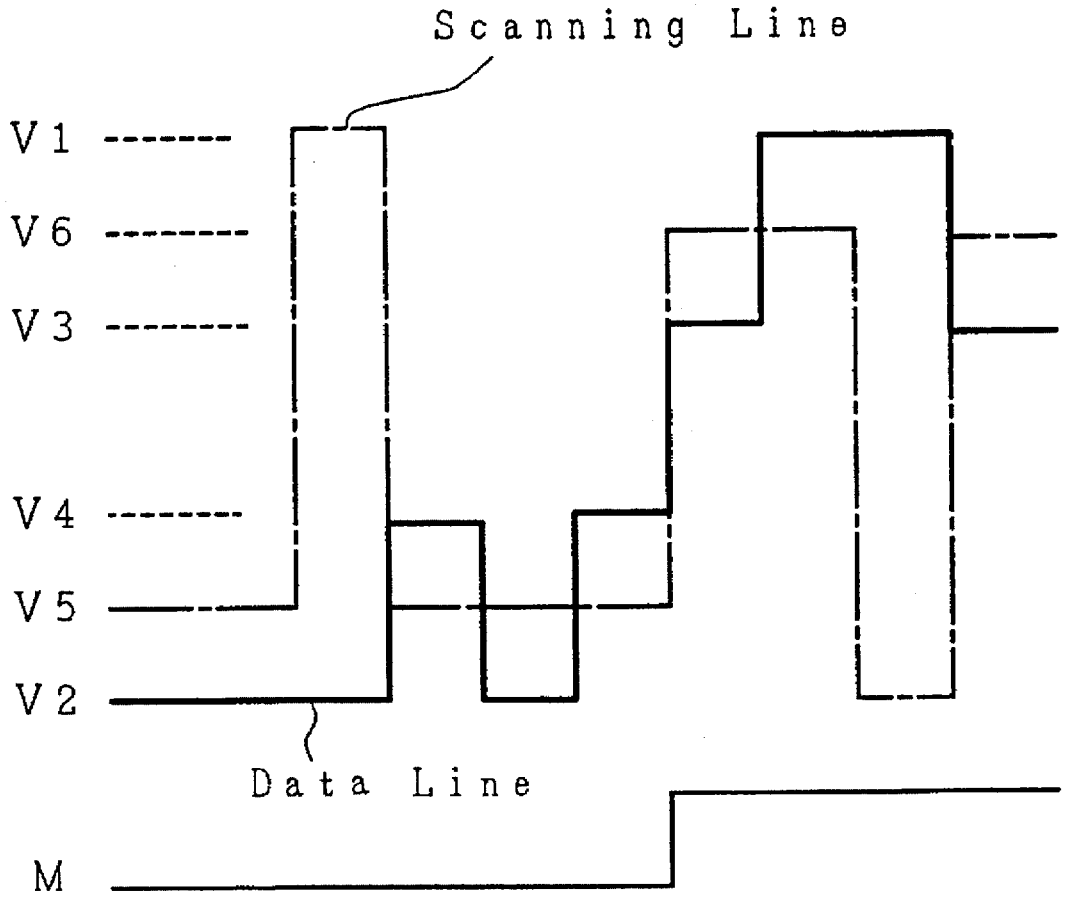
FIG. 6 (PRIOR ART)
FIG. 6 is a diagram showing a time chart indicating a data signal and a scanning signal applied to a liquid crystal within a conventional LCD.

As mentioned above and shown in FIG. 6, which is a time chart indicating a data signal and a scanning signal corresponding to that of a conventional LCD (FIG. 5), it will be understood that the electric potential consumption of the present invention is very much smaller than 25 V, which is the electric potential difference in the conventional LCD.

Accordingly, the liquid crystal display using the arrangement as shown in the above mentioned embodiment uses a 2 level driving voltage obtained from the input logic voltage, so the electric potential in the above mentioned embodiment is no more than 4 V, when the driving voltage is inverted in polarity.

Thus, when the charge and discharge electric current of the liquid crystal is 20 mA, almost all (18 mA) of the charge and discharge electric current is leakage electric potential.

And, the 3 level driving voltage for the scanning line is boosted by 5 times from the logic voltage, and the voltage supply circuit assigns the intermediate level as a non-select level signal and the other 2 voltage levels as a select level signal having inverted polarities. The electric current supplied from the 2 voltage levels assigned as a select level signal is a maximum of 2 mA. Accordingly, the expenditure of electric power is as follows:

$$V\times(18\ mA+(2\ mA\times5))=140\ mW$$

It will be understood from this formula that the expenditure of electric power is ⅓ lower than that of the conventional LCD.

In general, a high frame frequency causes a large expenditure of electric power because the charge and discharge electric current increases according to the frame frequency. For example, if the electric current is 20 mA when the frame frequency is 120 Hz, then it will be 60 mA, which is three times 20 mA, when the frame frequency is increased to 360 Hz. Accordingly, the expenditure of electric power is increased three times in the conventional LCD. However, the LCD using the present invention can reduce the expenditure of electric power to a level which is substantially the same as that of the conventional LCD, even if the frame frequency is increased three times.

A frame frequency of the above mentioned embodiment is preferably from twice 60 Hz or 75 Hz, the same as the conventional LCD, to 360 Hz, especially about 150 Hz to 180 Hz in consideration of the high speed response demanded in practical use.

As mentioned above, in the described embodiments, the LCD expends only a small electric power.

In addition, it is preferable that a liquid crystal used by the above mentioned LCD include 10–50 wt % of a phenylcyclohexane group liquid crystal having the formula

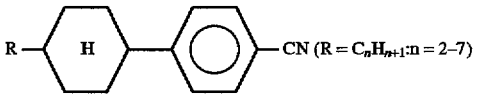

because it is necessary to use a liquid crystal having a good γ property to provide a high speed response in a STN (super twisted nematic) LCD having a twist angle of 200°–270°.

We claim:

1. A dynamic scattering matrix liquid crystal display comprising:

a plurality of data line electrodes;

a plurality of scanning line electrodes disposed so as to cross the data line electrodes and to be spaced apart from the data line electrodes;

a liquid crystal layer disposed between the data line electrodes and the scanning line electrodes;

data line drivers for selectively supplying one of a first level and a second level of a first voltage signal to each of the data line electrodes according to contents of a display image, the first level being produced from a first predetermined voltage without boosting the first predetermined voltage and the second level being produced from a second predetermined voltage without boosting the second predetermined voltage;

scanning line drivers for selectively supplying one of a highest level, an intermediate level, and a lowest level of a second voltage signal to each of the scanning line electrodes, the scanning line drivers selectively supplying one of the highest level and the lowest level of the second voltage signal according to a control signal for inverting a polarity of a voltage applied to the liquid crystal layer to each of the scanning line electrodes as a select level signal during predetermined time intervals, and supplying the intermediate level of the second voltage signal to each of the scanning line electrodes as a non-select level signal during time intervals other than the predetermined time intervals; and a voltage supply circuit for supplying the first voltage signal to the data line drivers and the second voltage signal to the scanning line drivers, the voltage supply circuit including a voltage booster for boosting the first level of the first voltage signal to produce the highest level of the second voltage signal, and for boosting the second level of the first voltage signal to produce the lowest level of the second voltage signal.

2. A dynamic scattering matrix liquid crystal display according to claim 1, wherein the voltage supply circuit further includes adjusting means for adjusting a middle level of the second voltage signal to be equal to a middle level of the first voltage signal, and for supplying the adjusted middle level of the second voltage signal to the scanning line drivers as the intermediate level of the second voltage signal.

3. A dynamic scattering matrix liquid crystal display according to claim 1, wherein the voltage booster further includes a pair of boosting circuits for boosting the two levels of the first voltage signal to the highest level and the lowest level of the second voltage signal, respectively, by boosting one level of the first voltage signal to the highest level of the second voltage signal on the positive polarity side and boosting the other level of the first voltage signal to the lowest level of the second voltage signal on the negative polarity side at the same boost ratio on the basis of a middle level of the first predetermined voltage and the second predetermined voltage.

4. A dynamic scattering matrix liquid crystal display according to claim 1, wherein the data line drivers and the scanning line drivers operate at a frame frequency of about 150 Hz to 360 Hz.

5. A dynamic scattering matrix liquid crystal display comprising:

a liquid crystal display panel having a plurality of data line electrodes and a plurality of scanning line electrodes disposed in a matrix arrangement;

a driver controller for generating control signals for controlling data line drivers for driving each of the data line electrodes and scanning line drivers for driving each of the scanning line electrodes; and a voltage supply circuit for generating source voltages having five mutually different levels from a pair of input logic voltages;

wherein the voltage supply circuit supplies first voltages including a highest level, an intermediate level, and a lowest level of the source voltages to each of the scanning line drivers, at least the highest level and the lowest level of the first voltages being generated by boosting the input logic voltages, and supplies second voltages including the other two levels of the source voltages to each of the data line drivers, the other two levels of the second voltages being generated without boosting the input logic voltages.

6. A dynamic scattering matrix liquid crystal display according to claim 5, wherein the voltage supply circuit includes adjusting means for adjusting a middle level of the highest level and the lowest level of the first voltages to be equal to a middle level of the other two levels of the second voltages, and for supplying the adjusted middle level of the first voltages to the scanning line drivers as the intermediate level of the first voltages.

7. A dynamic scattering matrix liquid crystal display according to claim 5, wherein the voltage supply circuit include a pair of voltage boosting circuits for boosting the input logic voltages to the highest level and the lowest level of the source voltages, respectively, by boosting one level of the input logic voltages to the highest level on the positive polarity side and boosting the other level of the input logic voltages to the lowest level on the negative polarity side at the same boost ratio on the basis of a middle level of the input logic voltages.

8. A dynamic scattering matrix liquid crystal display according to claim 5, wherein the data line drivers and the scanning line drivers operate at a frame frequency of about 150 Hz to 360 Hz.

* * * * *